US006708620B1

(12) United States Patent
Deckard et al.

(10) Patent No.: US 6,708,620 B1
(45) Date of Patent: Mar. 23, 2004

(54) HIGH STRENGTH CRIMP FOR FLARES

(75) Inventors: Dennis D. Deckard, Bedford, IN (US); David J. Mulinix, Bloomington, IN (US); Alphonso Cook, Jr., Bloomington, IN (US); Bernard G. Nail, Washington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/292,960

(22) Filed: Nov. 13, 2002

(51) Int. Cl.[7] ..... F42B 4/26
(52) U.S. Cl. ..... 102/336; 102/202.14
(58) Field of Search ..... 102/336, 340, 102/342, 357, 202.9, 202.14

(56) References Cited

U.S. PATENT DOCUMENTS 3,135,200 A * 6/1964 Jackson ..... 102/202.9
3,460,507 A * 8/1969 Little et al.
3,712,232 A * 1/1973 Abel et al.
3,782,285 A * 1/1974 Froehner
3,820,462 A * 6/1974 Jackson, Jr.
4,599,945 A 7/1986 Groustra et al.
4,646,643 A * 3/1987 Goldenberg ..... 102/464
4,646,644 A * 3/1987 Richmond et al. ..... 102/530
5,561,259 A 10/1996 Herbage et al.
H1603 H * 11/1996 Deckard et al. ..... 102/336
5,654,522 A * 8/1997 Endicott, Jr. et al. ..... 102/350
5,801,321 A * 9/1998 LaGrange et al. ..... 102/336

FOREIGN PATENT DOCUMENTS

DE 25 30 057 * 1/1977 ..... 102/340

* cited by examiner

*Primary Examiner*—Stephen M. Johnson
(74) *Attorney, Agent, or Firm*—John D. Lewis; Mark O. Glut

(57) ABSTRACT

A flare containment case is taught wherein the case has a end cap which is crimped into the sealed position with variously spaced crimps or indentations which may be machined in such a way as to increase and control the end cap release pressure.

15 Claims, 4 Drawing Sheets

HIGH STRENGTH CRIMP FOR FLARES

STATEMENT OF GOVERNMENT INTEREST

The invention described herein may be manufactured and used by or for the Government of the United States of America for governmental purposes without payment of any royalties thereon or therefor.

FIELD OF THE INVENTION

This invention pertains to the field of flares, and more particularly to the construction of the flare case for naval decoy flares for the protection of aircraft and other potential targets from hostile missiles and aircraft that target infrared energy. This field includes explosive cases of infrared flares, illumination flares or flares designed to emulate the infrared, visible light and or electromagnetic signature of an airborne missile, space craft or aircraft.

BACKGROUND OF THE INVENTION

Naval aviation has always had special requirements for aircraft and weapon systems and their countermeasure equipment not required by the United States military counterpart systems in the other services. These increased requirements, result in part from the tremendous forces generated by aircraft operating from a carrier deck. In aircraft operating from a carrier deck the force of a catapult boost to the platform and weapon system on take off and rapid de-acceleration of a tail hook arrested landing increase strength requirements. Also naval countermeasure systems are often stored on deployed ships where physical strength requirements are higher due to the more hostile corrosive and physical environment of a sea-going vessel.

The Navy has historically used cylindrical decoy flare containers while the Air Force and Army Air Corps used rectangular or square flare cases. Now when faced with increased standardization requirements between the services, the Navy is required to adapt some of the square or rectangle flares for naval use and these standardized flares must pass stringent naval safety and handling testing. Past testing of rectangular or square cased flares exhibited the end caps lacking the strength to contain the energetic material under the increased naval requirements. Various means to increase the push out force on the end caps have been tried and tested but generally increasing the push out force necessary to open the end cap also increases the pressure necessary to properly release the encapsulated payload when the impulse cartridge fires.

Staking, side crimps and end cap tabs have been tested as a possible solution to the problem but all have failed to increase the push out force required for naval testing parameters without increasing the vulnerability to water intrusion and corrosion. Pinning can meet the increased push out force but creates holes in the flare case that exacerbates the entry of water and increases damage from the corrosive naval operating environment and increases assembly costs. Magneforming has shown promise as a possible solution but is prohibitively expensive.

Consequently, a need remains for a reliable, safe construction technique for square, rectangular or cylindrical decoy flare cases which exhibit the increased push out force required for naval testing parameters while still meeting the release requirements upon firing, that is not prohibitively expensive.

SUMMARY OF THE INVENTION

An object of the invention is to provide an improved decoy flare of rectangular or square construction that increases the push out force necessary to keep a payload containment cap in place and thus avoids releasing the payload without firing the flare.

Another object of the present invention is to teach a standardized case for energetic infrared, visible light or electromagnetic flares that meet all services testing requirements.

Another object of the invention is to provide a flare case that avoids water intrusion apertures and thus increases corrosion resistance.

A still further object of the present invention is to provide a case improvement for square or rectangular flares that allows decoy flares produced by the various United States and NATO military services to pass the differing service test requirements for safety, ease of release, interoperability and standardization.

A further object of the present invention is to teach a flare case and payload containment cap for variously shaped flares that can be sealed with a sealant to reduce the possibility of water intrusion.

Another object of the present invention is to teach a decoy flare that has the increased strength necessary to avoid accidental release of the payload during storage, handling, and carrier operations without prohibitive increased manufacturing costs.

A further object of the present invention is to teach a case construction that can be employed in the new decoy flares currently under development, e.g., the MJU-53/B and MJU-61/B being designed for cross service use.

Still another object of the instant invention is to disclose a decoy flare that can pass the demanding safety and corrosion testing for naval shipboard operation without increasing the force required for releasing the payload containment cap beyond allowable levels upon firing the flare.

Another object on the instant invention is to teach a payload containment cap and means of affixing the cap within a flare case that allows for placement of the payload containment cap at any depth within the flare case thus accommodating different size payloads in a standard flare case.

A further object is to teach a flare case and payload containment cap that can be firmly held in place at any point within the flare case by indents impinged into the case whereby the payload containment cap is firmly affixed between indents and movement both outward or inward is avoided.

In accomplishing these and other objectives and features of the invention there is provided a cylindrical, rectangular or square flare case that uses a payload containment cap held in place by crimping the case at one or more corners or at measured spacing around a cylindrical case. One variation presses the case inward at one or more of the case corners to extend over the top of the payload containment cap, resulting in an increase of force required to force the cap off and release the payload. Another variation indents the case at one or more of the case corners in a way that the case is deformed inward and over the top of the payload containment cap thereby increasing the internal pressure necessary to force the cap off of the flare case. Another embodiment using a cylindrical case flare places crimps at a 120 degree spacing around the top perimeter resulting in three crimps per case. Still another embodiment of the present invention uses pairs of indents impinged in place at a desired depth in the flare case thus holding the payload containment cap from moving outward or inward, and allows placement of the payload containment cap at any distance within the flare case. The depth of the indenture or corner crimp may be varied so as to regulate the pressure required to jettison the end cap upon firing of the impulse cartridge when the flare is used. In general, cylindrical flares with standard end caps result in a higher internal release pressure found adequate in naval safety testing but the teachings of the present invention could be easily adapted to a cylindrical flare case where one wished to increase release pressure required to remove the end cap. The construction of flare cases taught by the instant disclosures can be used with silicone or other sealant known to those skilled in the art to reduce the possibility of water intrusion and increase corrosion control. It has also been shown advantageous to place a rubber pad between the payload containment cap and the payload thus reducing abrasive wear or shock in handling and storage.

The corner crimp technique is a new feature considered an advantage over most existing crimps in that they will retain heavier payloads in rectangular and square cases. The corner crimps also withstand environmental and durability tests without problems. The crimps are easily adjustable. The retaining force can be adjusted by changing the crimp angles and depths. The tooling required to produce the crimp is inexpensive and can be teamed with hydraulic, air or arbor presses.

BRIEF DESCRIPTION OF THE DRAWINGS

Having summarized the invention, a detailed description follows with reference being made to the accompanying drawings that form part of the specification, of which.

DESCRIPTION OF THE PREFERRED EMBODIMENTS

Figure 1:
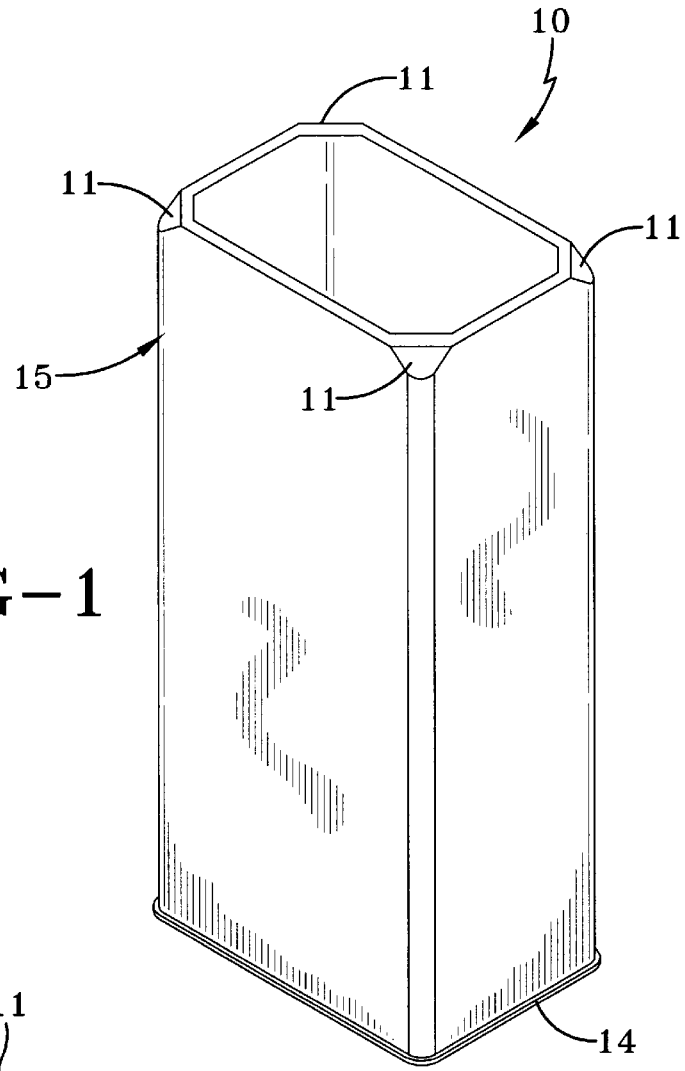
FIG. 1 is a view of a non-cylindrical flare case showing the corner crimps of the present invention.

Referring to the drawings a flare case indicated generally by the referenced numeral 10 is shown in various views. This flare case 10 may be of various shapes both cylindrical and other geometrical construction such as square, rectangular and triangular. The current invention is intended specifically to solve interoperability problems required to adapt Air Force and Army Air Corps flares to the more vigorous operating environment of the United States Navy and the drawings will concentrate on those case designs. It should be understood that while a cylindrical flare case design has generally been shown to have adequate strength and has historically been used by the US Navy, the present invention can be adapted with any cylindrical flare. When payload release force needs to be increased or where the payload is smaller than the flare case requiring the payload containment cap to be positioned within the case rather than at the end, the present invention can accommodate the changes. The preferred embodiment of both the indented and crimped flare case of the disclosed invention is with non-cylindrically shaped flare cases requiring payload containment cap release strengths beyond that obtained with a smooth case construction.

Turning now to FIG. 1 a case 10 is shown in a flare case of rectangular design with crimps 11 located on each of the four corners. The flare case of FIG. 1 shows the flare containment case to have a launcher and firing circuit end 14 and a payload release end 15. Crimps 11 are placed at each corner so as to stress the material at a high strength point before the crimps release. Crimps 11, placed at the top of each corner, are more effective and can be made much stronger than when crimps 11 are placed along the sides of a rectangle case, as the material along the sides has a tendency to flex and render the crimps ineffective or erratic with the amount of force required to release. Another embodiment of the present invention might place crimps 11 only on one pair of the diagonally opposing corners. This technique would attenuate the force required for the release of a payload. Likewise, the size of the crimp would intuitively affect the amount of force required for release.

Figure 2:
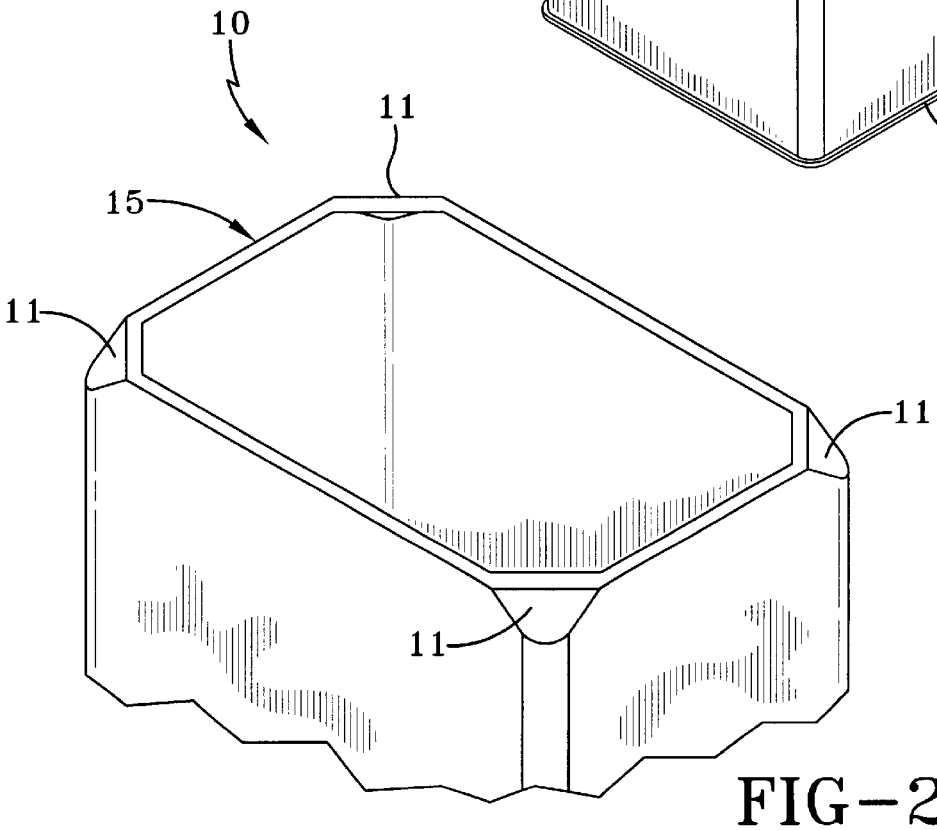
FIG. 2 is a closer view of the flare case of FIG. 1 that more clearly shows the impinged crimps at each corner of flare case 10.

FIG. 2 is a closer view of the flare case of FIG. 2 that more clearly shows the impinged crimps at each corner of flare case 10.

Figure 3:
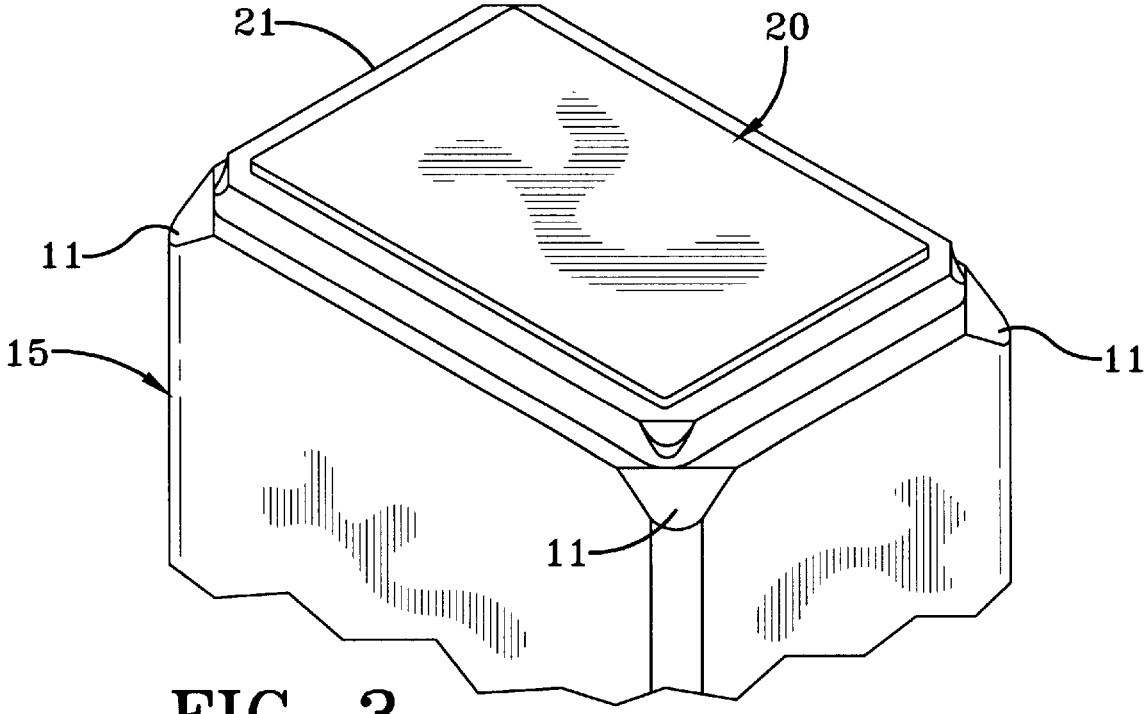
FIG. 3 is a view of the upper portion of a flare case shown with the payload containment cap held in place by the corner crimps of the present invention.

FIG. 3 shows a flare case 10 with a flare payload containment cap 20 having a recessed lip 21 which is under the crimps 11 when the top is assembled and crimped into place.

Figure 4:
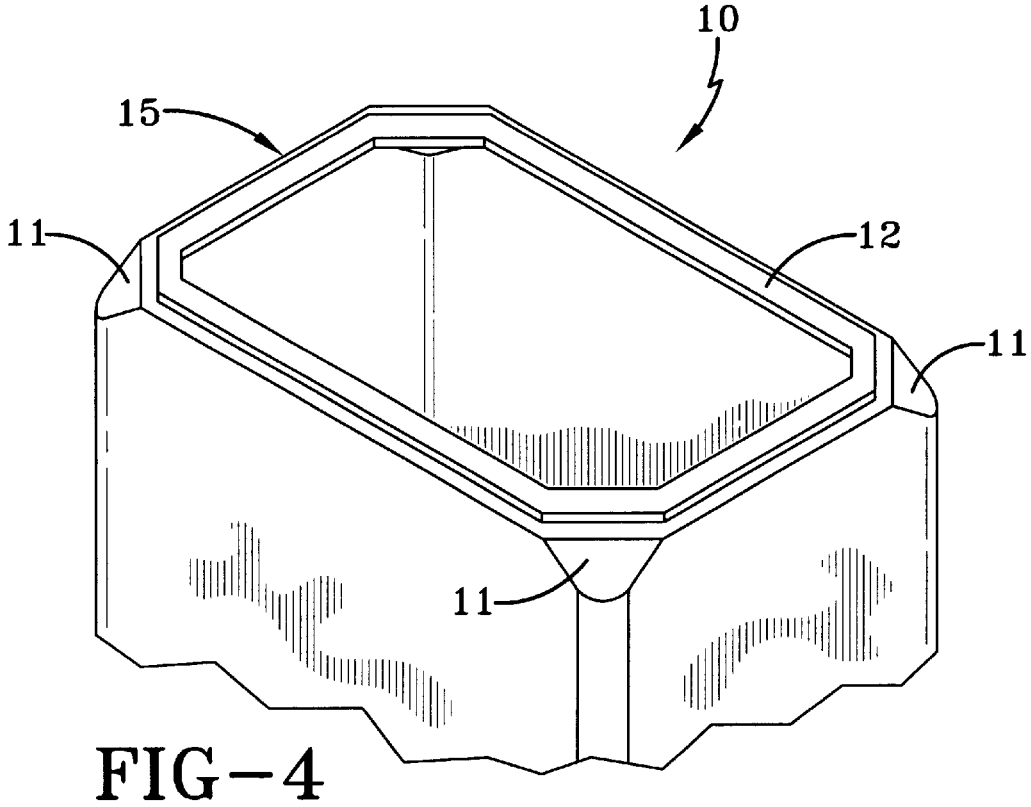
FIG. 4 is the top of a flare case having the signature corner crimps further enhanced with a silicone sealant.

FIG. 4 shows the flare case 10 of FIG. 3 with an application of sealant 12 sealing the case 10 with the cap 20 so as to avoid any aperture for moisture intrusion. Any sealant may be used but a silicone sealant tested provided good results and is anti corrosive.

Figure 5:
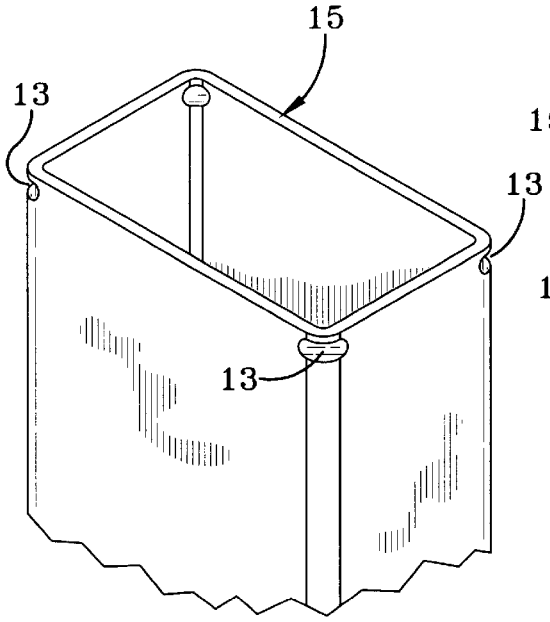
FIG. 5 is the upper portion of a rectangular flare case delineating the indented case of one embodiment of the present invention.

FIG. 5 shows a rectangular flare case where indentations are pressed into the case. These indentations extend into the case but do not puncture the flare case 10.

Figure 6:
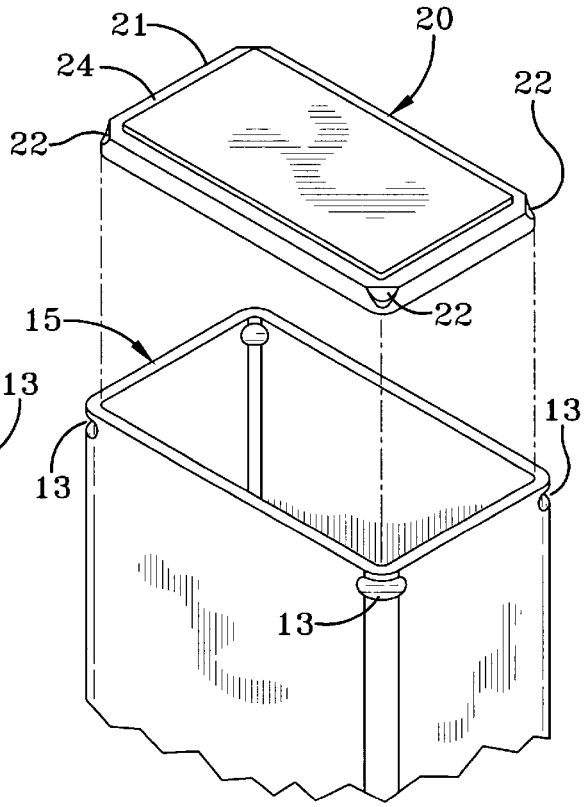
FIG. 6 is a view of the case of FIG. 5 shown in proximity to a sealable payload containment cap.

FIG. 6 shows case 10 of FIG. 5 with a corresponding payload containment cap or top 20 having a perimeter 21. The flare case payload containment cap 20 is further defined by a recessed lip 24 around the perimeter 21 operatively sized to accommodate one or more indentations 13 when the case payload containment cap 20 is in place within the flare containment case perimeter 21. The corner of the cap 20 may be beveled, creating bevels 22 that correspond with indentations 13 when top 20 is in place whereby the inwardly depending indentations 13 snugly fit over the top of the bevels 22 and hold top 20 firmly in place on case 10. The extent of the indentation 13 will vary the force required to jettison the top 20 and release a payload.

Figure 7:
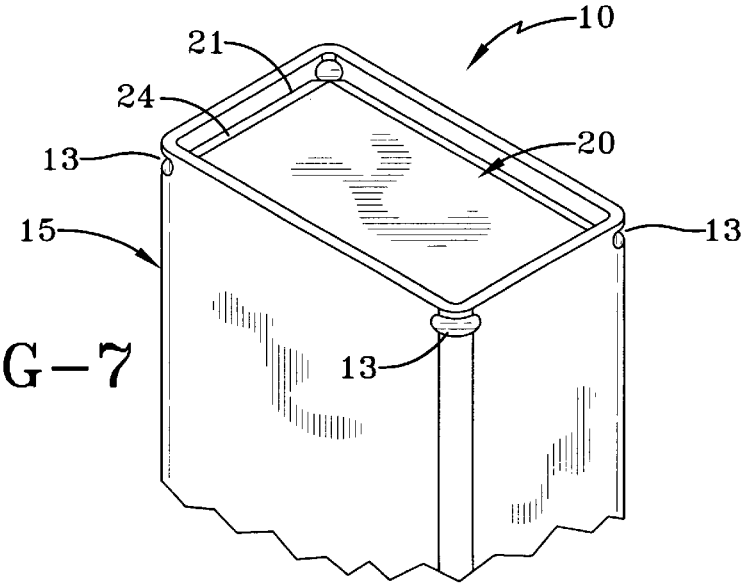
FIG. 7 is a view of one end of the flare case of FIG. 6 with the payload containment cap shown held in place with the corner indentures.

FIG. 7 shows the flare case of FIG. 6 assembled. As taught in conjunction with FIG. 4, a layer of sealant may be used to seal top 20 to case 10 and avoid water intrusion.

It is important to note that the invention may be practiced with many embodiments not particularly shown in the figures. Theoretically, a flare case may be manufactured in any geometric shape and the crimping and indentations of the present inventions may be employed on any flare case and the position and number may be varied to change the jettison force required to remove the flare cover when an impulse cartridge is fired. The indents impinged in the flare case may be positioned in pairs thus trapping a payload containment cap in place at any desired depth within the flare case. Another embodiment could contain one smaller payload held in place with a payload containment cap within the flare case and a second payload held in place with a payload containment cap at the release end of the flare case allowing for multistage flare packages.

Two different corner crimp variations have been designed and tested. Both a corner indented embodiment and a corner crimped embodiment worked well, retaining the payload as required and releasing the payload when the flare is functioned. The first corner crimp design tested was the version in FIG. 1. The corners of the metal flare case are bent down at an angle by press tooling. The depth and angle of the crimped corners help determine the retaining forces on the payload containment cap that in turn holds the payload in place. The material used in the fabrication of the containment cap also plays a large role in determining the retaining force of the crimp. The payload containment cap 20 denoted in the drawings may be manufactured out of any material and both metal and plastic caps were tested. If a plastic payload containment cap is used, the corners of the end cap will deform as the cap is pushed past the crimp.

Figure 9:
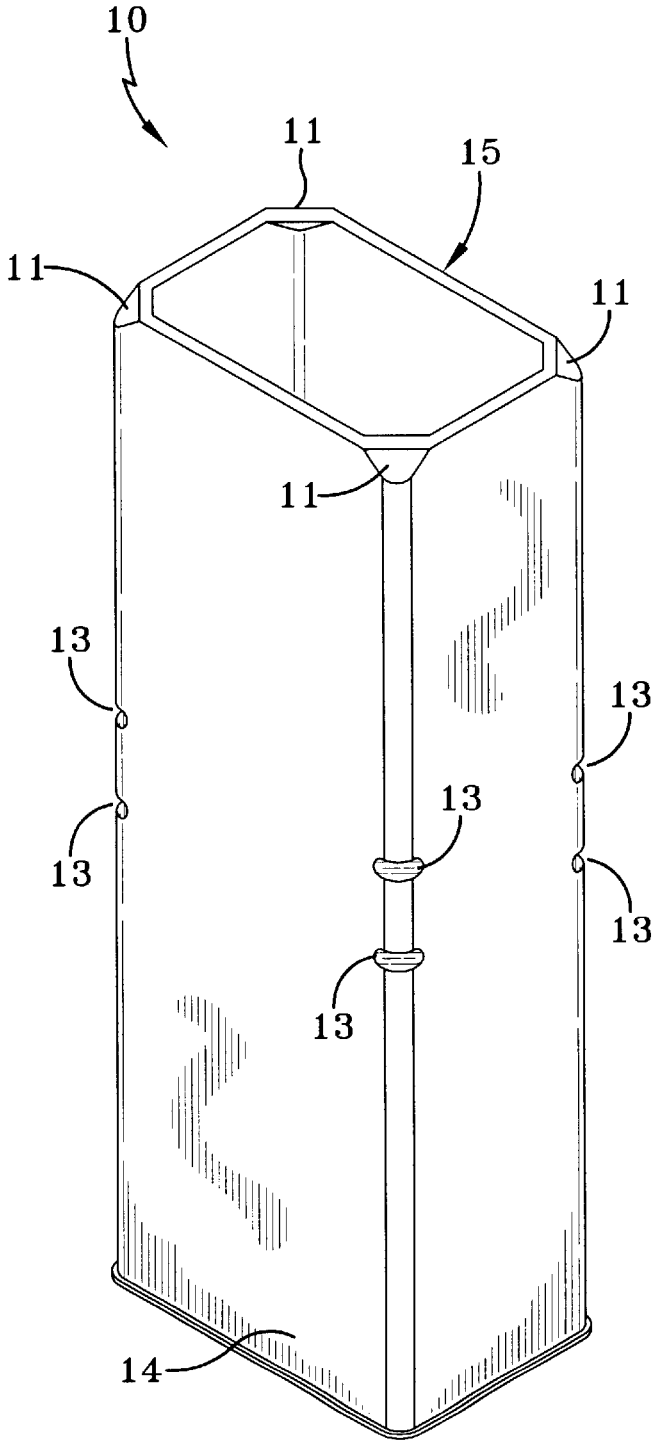
FIG. 9 teaches a dual stage flare case with two payloads separated by a payload containment cap.

FIG. 9 teaches a dual stage flare case 10 with standard corner crimps 11 for firmly containing the payload containment cap in place on the flare release end of the case. It also shows indents 13 located in pairs and operatively spaced so as to trap a payload containment cap in position holding a payload in place at the firing end of case 10 allowing another payload to be encased and held in place by the crimps 11 at the release end.

Figure 8A:
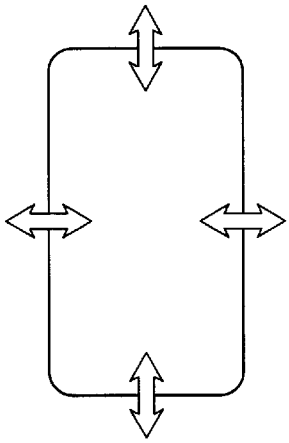
FIGS. 8*a, b* and *c* show stress vectors for the various geometrical shapes of the flare cases employing the present invention.
Figure 8B:
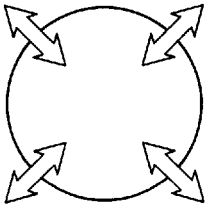
Figure 8C:
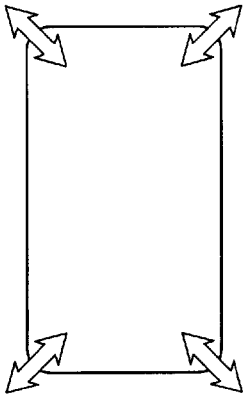

The corner crimps work well in rectangular and square cases because they take advantage of the material strength of the crimped items. FIG. 8*a*, FIG. 8*b* and FIG. 8*c* illustrate force vectors on different shaped cases. FIG. 8*a* shows arrows in side locations of a rectangular profile. Forces in these locations can easily flex a thin walled case and make crimps at these locations ineffective. FIG. 8*b* shows force vectors pointing outward from the center of a circular case profile. Forces in these locations are resisted by the hoop strength of the case material. Therefore, crimps on the perimeter of a cylinder tend to be very strong. FIG. 8*c* shows force arrows at corner locations of a rectangular case profile. Crimps put in the four corners of such a profile also tend to be very strong, more like the strength exhibited by a cylindrical case embodiment where the hoop strength of the material is stressed before the crimps release.

The corner crimp can be varied in numerous ways in order to obtain payload retainment/release requirements. The two ways illustrated in the drawings have both been extensively tested and work well. While the payload containment cap push out forces depend on a variety of factors, the containment cap material plays a large role. With thicker walled cases, the crimps tend to retain their shape, requiring the corners of the end cap to deform to allow the end cap to pass the crimps and release the payload. The angle and depth at which the crimp and payload containment cap corners engage also affect cap push out forces. These can be adjusted in a variety of ways to suit the particular application.

Reasonable other variations and modifications of the above described flare case are possible within the scope of the foregoing description, the drawings and the appended claims to the invention.

What is claimed is:

1. A flare containment case comprising:

a bottom end corresponding to a launcher and firing circuit and a top end, and a flare case payload containment cap operatively sized to sealably fit into said top end of the flare containment case, a layer of silicone sealant sealing said flare case payload containment cap within said top end of the flare case, and one or more indentations impinged into said top end of the flare case operatively positioned to partially extend over said flare case payload containment cap whereby said payload containment cap is held within the case by said one or more indentations.

2. A flare containment case of claim 1 wherein said flare case payload containment cap includes a perimeter, and said flare case payload containment cap is further defined by a recessed lip around the perimeter operatively sized to accommodate said one or more indentations when said case payload containment cap is in place within the flare containment case.

3. A flare containment case of claim 2 wherein said flare payload containment cap is further defined by bevels on said end cap operatively positioned to snugly cooperate with said one or more indentations.

4. A flare containment case of claim 2 wherein the flare case is rectangular in shape, and said one or more indentations impinged into said top end of the flare case are four in number and are strategically positioned at each corner of said top end to engage said recessed lip of said flare case payload containment cap whereby said flare case payload containment cap is held in place sealing the flare containment case.

5. A flare containment case of claim 2 wherein the flare case is rectangular in shape, and said one or more indentations impinged into said top end of the flare case are two in number and are positioned at two diametrically opposed corners of said top end strategically placed to engage said flare case payload containment cap whereby said flare case payload containment cap is held in place sealing the flare containment case.

6. A flare containment case of claim 2 wherein the flare case is rectangular in shape, and said one or more indentations impinged into said top end of the flare case are two in number and are strategically positioned at two diametrically opposed corners of said top end to engage said recessed lip of said flare case payload containment cap whereby said flare case payload containment cap is held in place sealing the flare containment case.

7. A flare containment case of claim 1 wherein the flare case is rectangular in shape, and said one or more indentations impinged into said top end of the flare case are four in number and are strategically positioned at each corner of said top end to engage said flare case payload containment cap whereby said flare case payload containment cap is held in place sealing the flare containment case.

8. A flare containment case of claim 1 wherein the flare case is rectangular in shape, and said one or more indentations impinged into said top end of the flare case are two in number and are strategically placed to engage said flare case payload containment cap whereby said flare case payload containment cap is held in place sealing the flare containment case.

9. A flare containment case comprising:

a bottom end corresponding to a launcher and firing circuit and a top end, and a flare case payload containment cap operatively sized to sealably fit into said top end of the flare containment case, a layer of silicone sealant sealing said flare case payload containment cap within said top end of the flare case, and one or more crimps pressed into said top end of the flare case operatively positioned to partially extend over said flare case payload containment cap whereby said payload containment cap is held within the case by said one or more crimps.

10. A flare containment case of claim 9 wherein said flare case payload containment cap includes a perimeter, and said flare case payload containment cap is further defined by a recessed lip around the perimeter operatively sized to accommodate said one or more crimps when said case payload containment cap is in place within the flare containment case.

11. A flare containment case according to claim 10 wherein said flare case payload containment cap is further defined by bevels operatively positioned to snugly fit under said one or more crimps.

12. A flare containment case of claim 10 wherein the flare case is rectangular, and said one or more crimps pressed into said top end of the flare case are four in number and are strategically positioned at each corner of said top end to engage said recessed lip of said flare payload containment cap whereby said flare case payload containment cap is held in place sealing the flare containment case.

13. A flare containment case of claim 10 wherein the flare case is rectangular in shape, and said one or more crimps pressed into said top end of the flare case are two in number and are strategically positioned at two diametrically opposed corners of said top end to engage said recessed lip of said flare payload containment cap whereby said flare case payload containment cap is held in place sealing the flare containment case.

14. A flare containment case of claim 9 wherein the flare case is rectangular in shape, and said one or more crimps pressed into said top end of the flare case are four in number and are strategically positioned at each corner of said top end to engage said flare case payload containment cap whereby said flare case end cap is held in place sealing the flare containment case.

15. A flare containment case of claim 9 further defined by indents impinged into the containment case operatively spaced in pairs at each corner of the containment case positioned to trap a second flare case containment cap in position holding the first payload of a dual payload flare in position within the flare case.

* * * * *